US005860546A

United States Patent [19]

Carrier

[11] Patent Number: 5,860,546

[45] Date of Patent: Jan. 19, 1999

[54] INTERFERENCE SQUEEZE CONTOUR SEAL ASSEMBLY CLOSURE HAVING A DUAL THICKNESS NECK PORTION

[75] Inventor: Frank Leslie Carrier, Milford, Ohio

[73] Assignee: The Procter & Gamble Company, Cincinnati, Ohio

[21] Appl. No.: 818,831

[22] Filed: Mar. 15, 1997

[51] Int. Cl.[6] ..... B65D 41/00

[52] U.S. Cl. ..... 215/354; 215/44; 215/45; 215/344

[58] Field of Search ..... 215/354, 341–345, 215/43, 45, 321; 220/288, 304

[56] References Cited

U.S. PATENT DOCUMENTS

| | | | |
|---|---|---|---|
| 1,937,000 | 11/1933 | Villanyi | 215/354 X |
| 2,035,972 | 3/1936 | Mangel . | |
| 2,762,381 | 9/1956 | Rainer | 220/304 X |
| 3,096,898 | 7/1963 | Hohl et al. | 215/345 |
| 3,145,686 | 8/1964 | Blythe | 215/354 X |
| 3,295,708 | 1/1967 | Wathen, Jr. | 215/43 |
| 3,297,185 | 1/1967 | Plymale . | |
| 3,376,991 | 4/1968 | Deaver . | |
| 3,405,831 | 10/1968 | Hudson . | |
| 3,435,978 | 4/1969 | Wittwer . | |
| 3,445,022 | 5/1969 | Cilluffo . | |
| 3,494,496 | 2/1970 | Livingstone | 215/344 X |
| 3,592,349 | 7/1971 | Baugh | 215/45 X |
| 3,682,345 | 8/1972 | Baugh . | |
| 3,696,957 | 10/1972 | Van Baarn . | |
| 3,741,421 | 6/1973 | Wittwer . | |
| 3,788,510 | 1/1974 | Collins | 215/354 X |
| 3,888,376 | 6/1975 | Cooke . | |
| 3,952,899 | 4/1976 | Cooke . | |
| 3,963,139 | 6/1976 | Gach . | |
| 3,979,001 | 9/1976 | Bogert . | |
| 4,007,850 | 2/1977 | Beaugrand . | |
| 4,053,077 | 10/1977 | DeFelice . | |
| 4,084,716 | 4/1978 | Bogert . | |
| 4,084,717 | 4/1978 | King . | |
| 4,084,957 | 4/1978 | Ernst . | |
| 4,139,112 | 2/1979 | Cooke . | |
| 4,177,906 | 12/1979 | Von Hagel | 215/45 X |
| 4,193,509 | 3/1980 | Dunn, Jr. et al. . | |
| 4,270,664 | 6/1981 | Buono . | |
| 4,289,248 | 9/1981 | Lynn . | |
| 4,294,370 | 10/1981 | Toeppen . | |
| 4,322,012 | 3/1982 | Conti | 215/344 |
| 4,345,691 | 8/1982 | Burke . | |
| 4,349,116 | 9/1982 | Luenser . | |
| 4,387,822 | 6/1983 | Lynn . | |
| 4,461,394 | 7/1984 | Sendel et al. . | |
| 4,540,102 | 9/1985 | Weidmer | 215/341 X |
| 4,697,715 | 10/1987 | Beruvides . | |
| 4,711,365 | 12/1987 | Fomby | 220/288 |
| 4,770,308 | 9/1988 | Lynn . | |
| 5,060,813 | 10/1991 | Gollasch et al. | 215/354 X |

(List continued on next page.)

FOREIGN PATENT DOCUMENTS

| | | | |
|---|---|---|---|
| 48206 | 6/1982 | Canada | 215/344 |
| 397146 | 5/1965 | Netherlands | 220/304 |
| 1163363 | 9/1969 | United Kingdom | 220/304 |
| 2 100 236 | 12/1982 | United Kingdom . | |
| 2 159 801 | 12/1985 | United Kingdom . | |

*Primary Examiner*—Stephen K. Cronin
*Assistant Examiner*—Robin A. Hylton
*Attorney, Agent, or Firm*—Elizabrth M. Koch

[57] ABSTRACT

A squeeze contour seal assembly includes a container and a cap. The container has a neck portion which forms an opening. The neck portion has first and second wall thicknesses and screw threads for engaging the cap. The first wall thickness is greater than said second wall thickness. The cap has grooves for engaging the screw threads and a plug seal for releaseably engaging the opening when the screw threads and the grooves are threadably engaged. The second wall thickness engages a slot formed between the plug seal and the cap, thereby creating an interference fit between the neck portion and the plug seal and providing a leak free seal.

10 Claims, 3 Drawing Sheets

U.S. PATENT DOCUMENTS

| | | | |
|---|---|---|---|
| 5,133,471 | 7/1992 | Pujol Almirall | 215/354 X |
| 5,169,033 | 12/1992 | Shay . | |
| 5,184,747 | 2/1993 | Nolte | 220/288 X |
| 5,213,225 | 5/1993 | King et al. . | |
| 5,238,152 | 8/1993 | Mass et al. | 222/153 |
| 5,405,057 | 4/1995 | Moore | 222/153.14 |
| 5,421,470 | 6/1995 | Dudzik | 215/343 X |
| 5,549,213 | 8/1996 | Robbins, III et al. | 215/354 X |
| 5,672,321 | 9/1997 | Daykin | 215/354 X |
| 5,738,231 | 4/1998 | Montgomery | 215/44 |

INTERFERENCE SQUEEZE CONTOUR SEAL ASSEMBLY CLOSURE HAVING A DUAL THICKNESS NECK PORTION

FIELD OF THE INVENTION

This invention relates to the field of closure assemblies, and more particularly, to a squeeze contoured seal assembly.

BACKGROUND OF THE INVENTION

Conventional liquid filled plastic bottles which utilize a threaded plastic cap have typically had problems with leaking. Seals such as plug seals and conventional gaskets are known and reduce the problem; however, neither plug seals nor conventional gaskets provide a leak free seal when using closures that are twisted to a particular position and not a specific torque. As a result, conventional plug seals and gaskets will leak when rocked or wobbled. Typically, rocking the bottle to one side will cause the seal on the opposite side to be broken. As a result, the plug seal and gasket will leak.

Another problem with using conventional gaskets to alleviate the problem with leaking is that the gasket increases the complexity of the design and the cost. In addition, if the gasket is not aligned properly, the leaking problem will actually be increased.

Therefore, what is needed is a seal which is leak free regardless of rocking or wobbling of the bottle.

SUMMARY OF THE INVENTION

A squeeze contour seal assembly, comprises a container having a neck portion extending therefrom and forming an opening, the neck portion having first and second wall thicknesses and at least one screw thread, the first wall thickness being greater than the second wall thickness; and a cap having at least one groove for engaging the at least one screw thread and a seal for releaseably engaging the opening when the at least one screw thread and the at least one groove are threadably engaged, wherein the second wall thickness engages a slot formed between the seal and the cap, thereby creating an interference fit between the neck portion and the seal and providing a leak free seal.

DETAILED DESCRIPTION OF THE INVENTION

Figure 1:
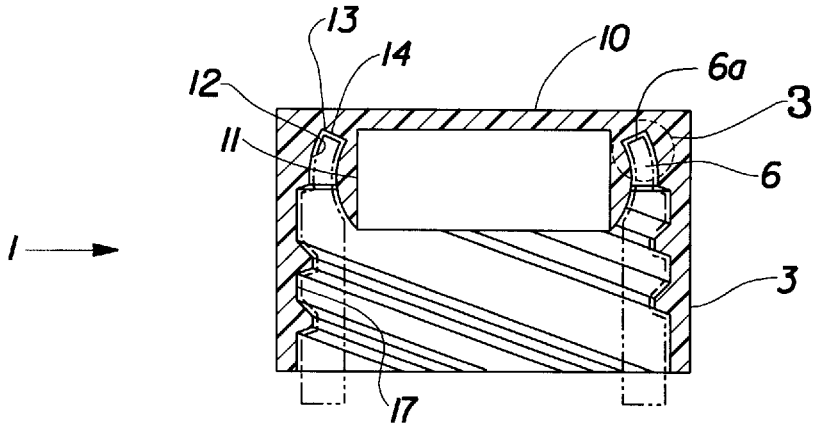
FIG. 1 is a cross sectional view of the preferred cap of the present invention.
Figure 2:
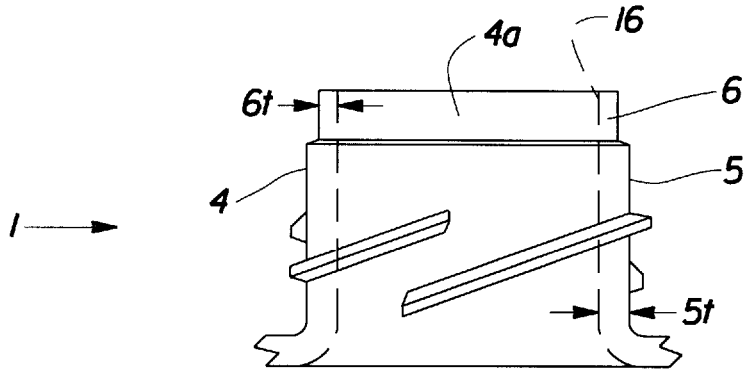
FIG. 2 is a side view of the preferred container's neck portion of the present invention.
Figure 2A:
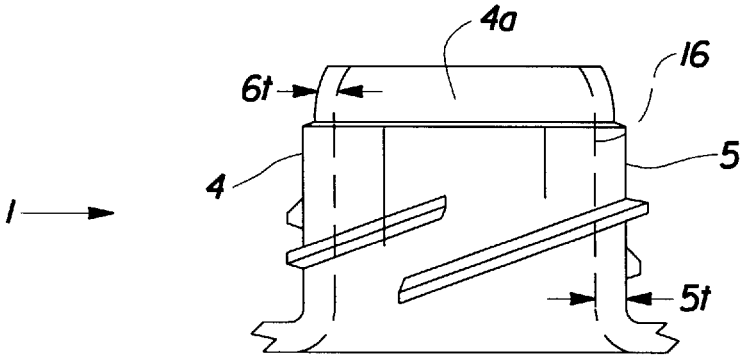

Referring to FIGS. 1 and 2, a preferred squeeze contour seal assembly 1 comprises a container 2 and a cap 3. The container 2 includes a neck portion 4, which forms an opening 4*a* and has first and second walls 5, 6, respectively, with first and second wall thicknesses 5*t* and 6*t*, respectively. The first wall thickness 5*t* is greater than the second wall thickness 6*t*. The neck portion 4 also includes threads 7 for engaging the cap 3.

The cap 3 includes a seal 8 which extends from the inner surface 9 of the cap's top portion 10. An outer surface 11 of the seal 8 is preferably contoured such that the outer surface 11 and a contoured inner surface 12 of the cap 3 form a contoured slot 13. The outer surface 11 of the seal 8 has a smaller diameter at the top 14 than at the mid-section 15. However, both the diameter at the top 14 and the diameter at the mid-section 15 is larger than the diameter at an inner surface 16 of the neck portion 4. However, the cap 3 also includes grooves 17 for engaging the neck portion 4 of the container 2. Preferably, the seal 8 comprises a plug seal but may comprise similar structures known to those skilled in the art without deviating from the intent of the invention.

Upon engagement of the threads 7 with the grooves 15, the second wall 6 of the neck portion 4 engages the contoured slot 13. Upon such engagement, the outer surface 11 of the plug seal 8 and the inner surface 12 of the cap 3 will force the thinner second wall 6 within the slot 13, thus wrapping tightly around the plug seal 8 and providing a leak free seal.

In addition, the interference fit formed between the second wall 6 and the slot 13 increases the sealing pressure between the plug seal 8 and the neck portion 4. This interference fit also resists wobbling or rocking of the cap 3 and the leaking associated with it. The interference fit formed between the second wall 6 and the slot 13 could be increased by forming the plug seal of a relatively soft flexible material such as rubber, urethane or sanoprene, without over stressing the neck portion 4 of the container 2.

Preferably, the first wall 5 is sufficiently thick to provide strength and rigidity in the threaded area while the second wall 6 is sufficiently thin to allow for ease of bending and wrapping within the slot 13 as the cap 3 threadably engages the neck portion 4. The bending and wrapping of the second wall 6 provides a leak free seal particularly with caps that are tightened to a particular position and not a specific torque. Therefore, a leak free seal is provided even where a slight wobbling of the cap is present.

Figure 3:
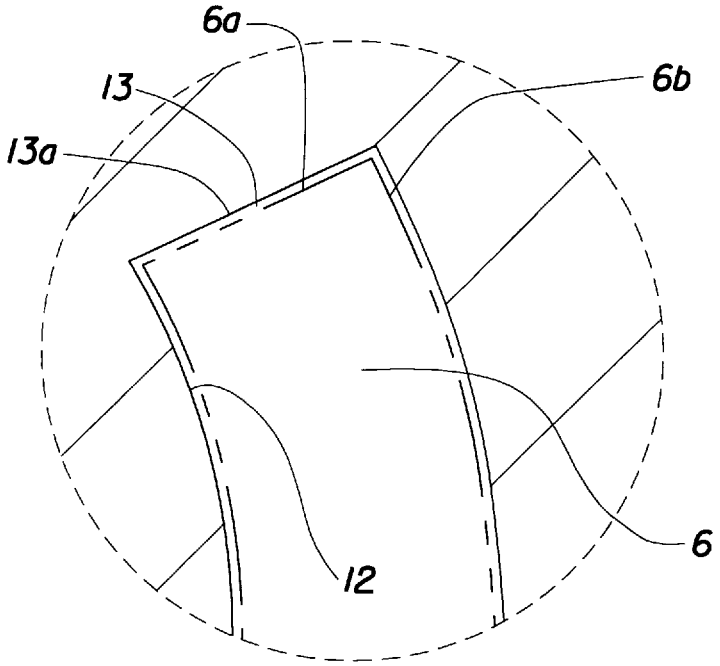
FIG. 3 is an enlarged view of the engagement of the second wall within the slot according to the preferred embodiment of the present invention

Referring to FIG. 3, preferably a top surface 13*a* of the slot 13 is angled and a top surface 6*a* of the second wall 6 is also angled substantially to the same degree as the angle of the slot 13. In addition, the top edge 6*b* of the second wall 6 is preferably radiused; however, the top edge 6*b* could be angled without deviating from the intent of the invention. By angling the top surface 6*a* of the second wall 6 and the top surface 13*a* of the slot 13, wobbling and rocking motions of the cap 3 are substantially eliminated, thus producing a leak-free seal between the cap 3 and neck portion 4.

Figure 4:
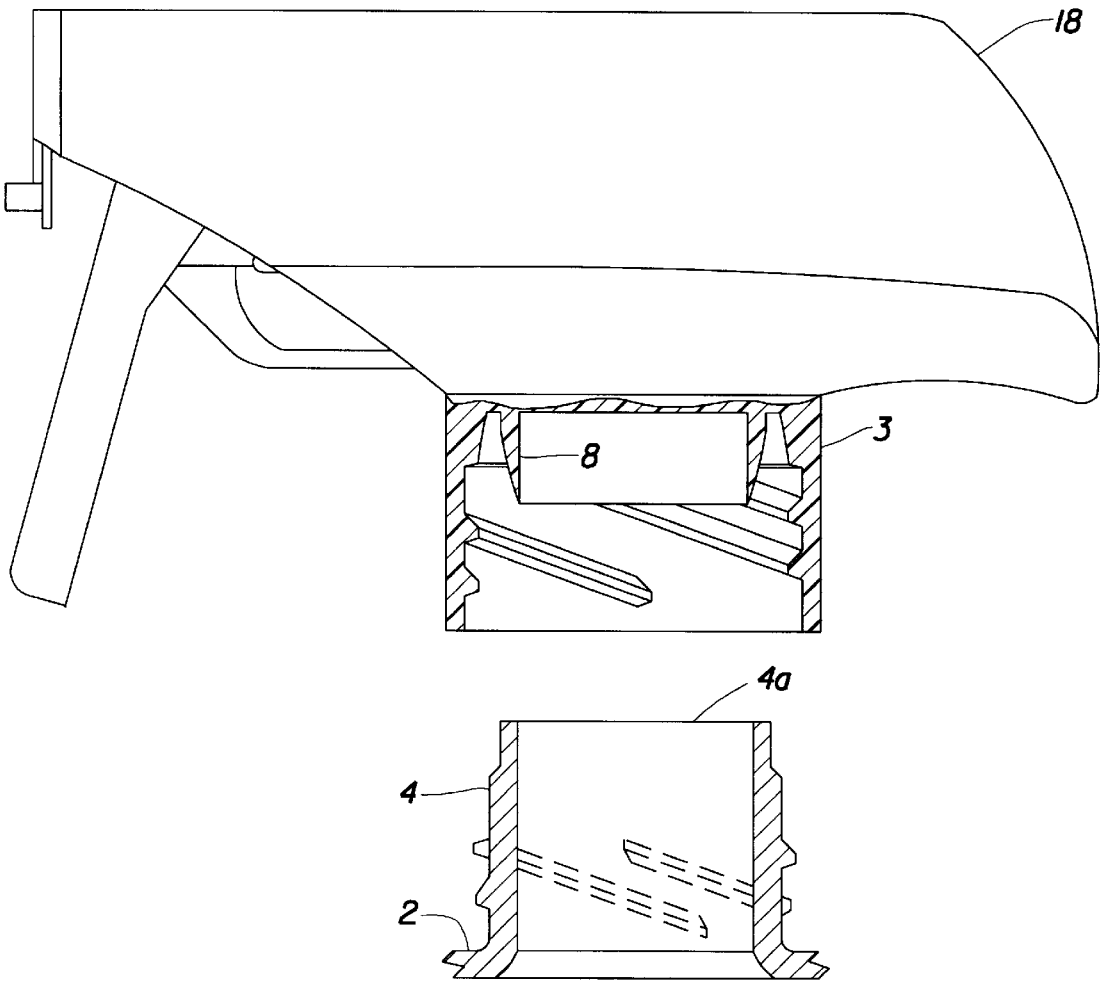
FIG. 4 is a side view of a trigger sprayer cap having interference threads for engagement with the neck portion of FIG. 2 according to the preferred embodiment of the present invention.

Referring to FIG. 4, the interference fit created by the second wall 6 being forced within the slot 13 enables the cap 3 and neck portion 4 to maintain a seal when the cap 3 is turned to a specific position rather than a specific torque, particularly when a trigger sprayer 18 is mounted to the cap 3. Thus, the engagement of the second wall 6 and the slot 13 substantially eliminates wobbling, rocking, and "back-off" of the cap 3 which results in a substantially leak-free seal between the container 2 and the cap 3 when the cap 3 is turned to a particular position as opposed to torquing the cap 3 to a specific load.

While the embodiment of the invention shown and described is fully capable of achieving the results desired, it is to be understood that this embodiment has been shown and described for purposes of illustration only and not for purposes of limitation. Other variations in the formn and details that occur to those skilled in the art and which are within the spirit and scope of the invention are not specifically addressed. Therefore, the invention is limited only by the appended claims.

What is claimed is:

1. A squeeze contour seal assembly, comprising:

a container having a neck portion extending therefrom and forming an opening, said neck portion having first and second wall thicknesses and at least one screw thread, said first wall thickness being greater than said second wall thickness; and a cap having at least one groove for engaging said at least one screw thread and a contoured seal for releaseably engaging said opening when said at least one screw thread and said at least one groove are threadably engaged, wherein said second wall thickness engages a contoured slot formed between an outer contoured surface of said seal and an inner contoured surface of said cap, wherein said seal has a smaller diameter at the top, where said seal is attached to said cap, than at an outer surface of a mid-section of said seal, and an inner surface of said neck portion has a smaller diameter than said outer surface of said mid-section of said seal, thereby creating an interference fit between said neck portion and said seal and providing a leak free seal by sealing said opening.

2. The squeeze contour seal assembly of claim 1, wherein said mid-section of said seal forms a maximum sealing pressure location when said container and said cap are threadably engaged.

3. The squeeze contour seal assembly of claim 2, wherein said second wall thickness is forced within said contoured slot, and around said contoured seal, upon engagement of said at least one thread and said at least one groove.

4. The squeeze contour seal assembly of claim 3, wherein said outer contoured surface of said seal has a radius equal to the distance from said maximum sealing pressure location to a fulcrum on a top surface of said neck portion.

5. The squeeze contour seal assembly of claim 1, further comprising a trigger sprayer pump mounted on said cap.

6. The squeeze contour seal assembly of claim 1, wherein said second wall thickness creates dual sealing contact points upon engagement within said contoured slot, said first sealing contact point created by engagement of said second wall thickness with an inner surface of said cap and said second sealing contact point created by engagement of said second wall thickness with an outer surface of said seal.

7. The squeeze contour seal assembly of claim 1, wherein said contoured seal comprises a plug seal.

8. The squeeze contour seal assembly of claim 1, wherein a top surface of said contoured slot is angled.

9. The squeeze contour seal assembly of claim 8, wherein a top surface of said second wall thickness is angled to engage said slot angle.

10. The squeeze contour seal assembly of claim 9, wherein a top edge of said second wall thickness is radiused.

* * * * *